United States Patent [19]

Jones et al.

[11] Patent Number: 4,541,139

[45] Date of Patent: Sep. 17, 1985

[54] BROOM SHROUD

[75] Inventors: David A. Jones, Kettering, Ohio; Daniel A. Maust, Winfield, Ill.

[73] Assignee: The Drackett Company, Cincinnati, Ohio

[21] Appl. No.: 500,662

[22] Filed: Jun. 3, 1983

[51] Int. Cl.[4] ..... A46B 9/08

[52] U.S. Cl. ..... 15/171; 15/145; 15/146; 15/176; 403/290

[58] Field of Search ..... 15/159 R, 171, 175, 15/176, 145, 146, 147 R, 144 B, 229 A; 403/290, 299, 21, 263, 342, 343

[56] References Cited

U.S. PATENT DOCUMENTS

| | | | |
|---|---|---|---|
| 91,907 | 6/1869 | Burnett | 15/145 X |
| 1,210,319 | 12/1916 | Houston | 15/145 |
| 2,279,324 | 4/1942 | Pallen | 403/290 X |
| 2,843,400 | 7/1958 | Van Doren | 285/7 |
| 2,902,704 | 9/1959 | Schwartz | 15/229 A |
| 2,993,222 | 7/1951 | Laymon | 15/234 |
| 3,328,822 | 7/1967 | Sellesi | 15/229 A |
| 3,380,097 | 4/1968 | Pharris | 15/145 |
| 3,682,516 | 8/1972 | Savage | 306/30 |
| 4,373,828 | 2/1983 | Sartori | 403/263 |
| 4,384,383 | 5/1983 | Bryant | 15/176 X |
| 4,431,092 | 2/1984 | Kloster | 403/342 |

FOREIGN PATENT DOCUMENTS

| | | | |
|---|---|---|---|
| 651283 | 10/1962 | Canada | 403/342 |
| 360453 | 10/1922 | Fed. Rep. of Germany | 15/146 |

*Primary Examiner*—Peter Feldman

*Attorney, Agent, or Firm*—Charles J. Zeller

[57] ABSTRACT

A broom shroud that reduces the tendency of the broom handle to disassociate therefrom in view of forces encountered during use, the broom shroud comprising a broom shroud housing having a neck member having a bore, the neck member comprising a threaded collet or exterior neck portion having a plurality of vertical through slots, and a socket or interior neck portion; an internally threaded locking cap adapted to engage the collet, and means for securing bristles to the housing. Fastening the cap to the housing compresses the slotted portions of the collet, the collet tightly engaging the broom handle received by the bore. Preferably, the socket has a threaded section to receive a threaded end of the broom handle, thereby providing dual fastening means for the handle to the shroud.

33 Claims, 8 Drawing Figures

Fig. 1.
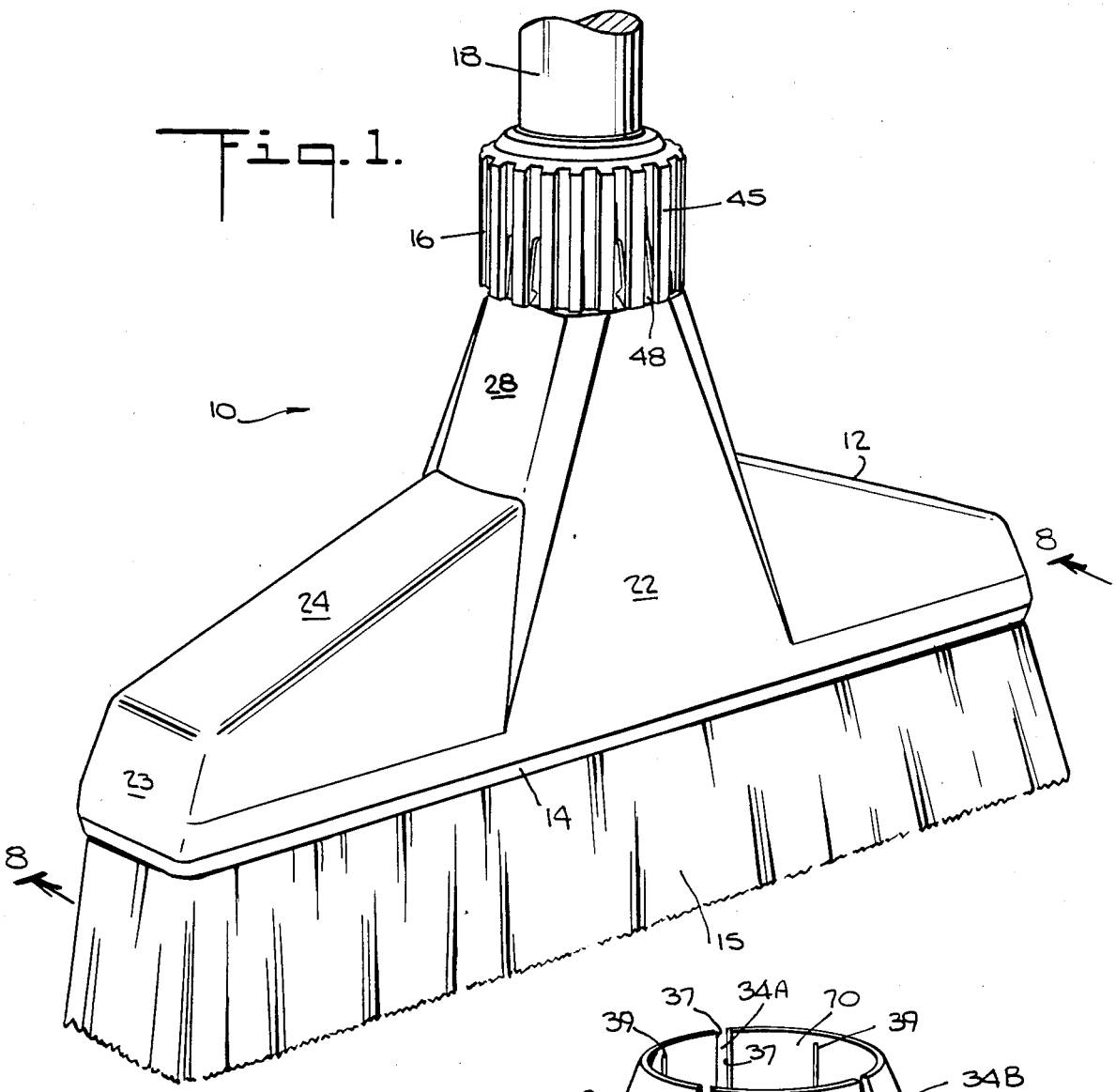
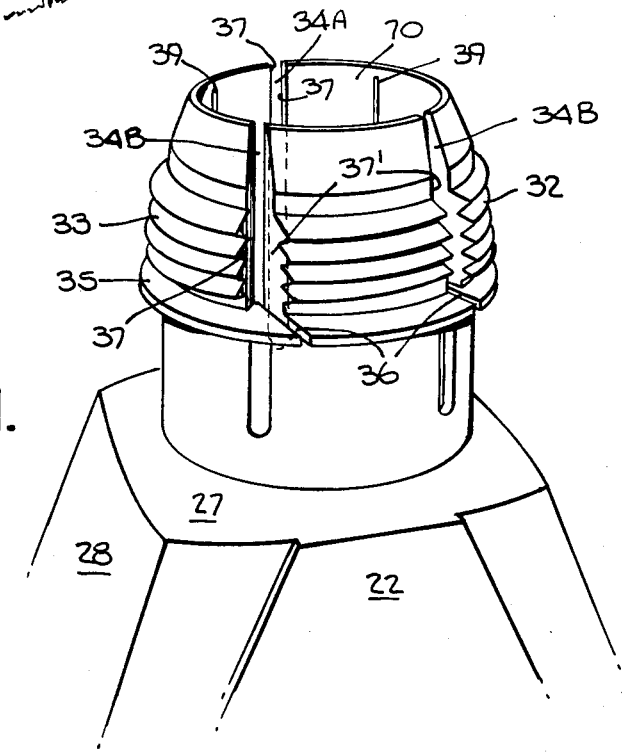
Fig. 3.

BROOM SHROUD

FIELD OF INVENTION

The present invention relates to a broom shroud having a collet clamp retaining means for a broom handle, the collet being split by two or more slots to effect compression thereof about the broom handle when the collet is engaged by a locking cap therefor. More specifically, the present invention relates to a broom shroud having dual broom handle fastening means, one of which is the aforesaid collet clamp.

BACKGROUND OF INVENTION

Upright brooms of conventional design have the handle permanently affixed, through various means, to the broom head and to the bristles, so that when one component breaks or wears out, the entire product must be replaced. Upright brooms with removable handles, through use of a threaded handle and socket, are not satisfactory because the broom handle threads and/or the socket threads erode, the force exerted during use being localized at the connection. Furthermore, the force at this pivot point is normal to the front and rear sides of the broom head in view of a back and forth sweeping motion applied by the user; which aggrevates the problem. Push brooms typically have a socket connection. Again, when the threads erode or if the socket becomes enlarged, the handle no longer can be securely fastened to the broom head, and a replacement handle may or may not solve the problem. Even when the threads are relatively satisfactory, ordinary use of the broom results in a gradual loosening of the handle, requiring tightening.

SUMMARY OF INVENTION

It is an object of the present invention to provide a broom shroud that greatly reduces the tendency of the broom handle to disassociate therefrom during use.

It is another object of this invention to provide a broom shroud that distributes the forces encountered during use over a greater surface area, rather than at a single pivot point.

A primary object of this invention is to provide a broom shroud having dual fastening means for the broom handle, one such means being a collet clamp adapted to compressively engage the broom handle at a point distal from the end of same, the other fastening means being a threaded connection of the broom handle directly into a socket or interior neck portion of the shroud.

Another aspect of the present invention is to provide a locking cap for the collet, said locking cap being loosely connected to the collet without threaded engagement, thereby preventing loss during shipment and use.

These and other aspects and advantages of the present invention will be readily understood upon an inspection of the drawings and upon a reading of the description of the preferred embodiment. A summary of the invention follows.

The broom shroud of the present invention comprises a broom shroud housing having a neck member having a bore to receive a broom handle, the neck member comprising a collet or exterior neck portion extending upwardly from the top of the housing, the collet being provided with an externally threaded section, a plurality of vertical through slots extending from the top of the collet through the threaded section, and a socket or interior neck portion extending inwardly into the housing from the collet; an internally threaded locking cap adapted to engage the collet, and means for securing bristles to said housing. Fastening the locking cap to the housing compresses the slotted portions of the collet, the collet tightly engaging the broom handle received by the bore.

A preferred number of slots in the collet is three or four, and collet segments of about 75° to 150° of arc are formed thereby. The threaded section of the collet may have a slight divergent taper from top to bottom to ensure compressive closure of the collet about the broom handle, the taper being up to about 10° off vertical.

The bore of the socket can be threaded to receive a threaded end of the broom handle, and preferably extends sufficiently into the housing to receive a sleeve of a bristle block, the bristle block being matable with the peripheral bottom edge of the housing, which is open at the bottom. The bristle block is secured to the housing by adhesive, or by other suitable means.

In the preferred embodiment, the slots in the collet are three in number, with one slot diametral to the collet, and the two remaining slots having a diametral wall and a beveled wall. In addition, this embodiment provides a split retaining ring below the threaded section, which ring retains the locking cap in loose engagement, the cap having lock projections that engage the underside of the ring.

BRIEF DESCRIPTION OF DRAWINGS

FIG. 1 is an assembled perspective view of a broom incorporating the preferred embodiment of the broom shroud of the present invention.

FIG. 3 is an enlarged perspective view of the collet.

DETAILED DESCRIPTION OF THE PREFERRED EMBODIMENT

The broom shroud of the present invention is intended for incorporation with brooms having replaceable handles, for example, upright brooms and push brooms. Generally, the handles used in connection with conventional upright brooms are permanently attached to the broom head and bristles. The handles used in connection with conventional push brooms have a threaded end, which end is fastened into a central threaded bore or socket in the shroud or head. The threads in the handle are typically unitary thereto, although a threaded metal ferrule may be provided to prevent splitting and to provide a tighter fit. Attempts have also been made to secure threaded handles in a socket of an upright broom, in a manner analogous to the push broom. A common complaint with conventional brooms having a socket type handle connection is that, after a period of use, the threads in the handle wear, or the threads in the socket enlarge, it being impossible to then securely fasten the handle to the shroud. This problem is more acute with respect to upright brooms having socket connection means in view of the back and forth sweeping motion associated therewith, and therefore a socket connection is not commonly used.

Accordingly, the broom shroud of the present invention provides a method of fastening the handle to the shroud that is adapted to reduce greatly the tendency of the handle to disengage inadvertently from the shroud. In this regard, the preferred embodiment of the invention utilizes a shroud having dual fastening means, one such means being the threaded connection between handle and shroud, a specially designed interior neck portion or socket being provided therefor, and the other means being a collet clamp connection wherein a collet or exterior neck portion of the shroud compressively engages the shaft of the handle when the locking cap is tightened about the collet.

Although it is preferred that both fastening means be employed to secure the handle to the shroud, the depth of the socket or interior neck portion within which the end of the handle resides, in combination with the collet connection, secures the handle to the shroud in a manner that distributes the force applied to the end of the handle during use and, therefore, lessens the tendency of the handle to disengage from the housing as compared to the conventional fastening method referred to above. Hence, it is not essential that the handle used with the shroud be threadedly connected thereto, nor is it essential that the interior neck portion be threaded, inasmuch as an unthreaded handle extends into the neck member such that the force applied during use of the broom is distributed to the large peripheral wall surface area of the collet and of at least a portion of the socket rather than localized. This distance is preferably between 1 to about 2 inches, as measured from the top of the collet, in the case of an unthreaded handle.

Figure 2:
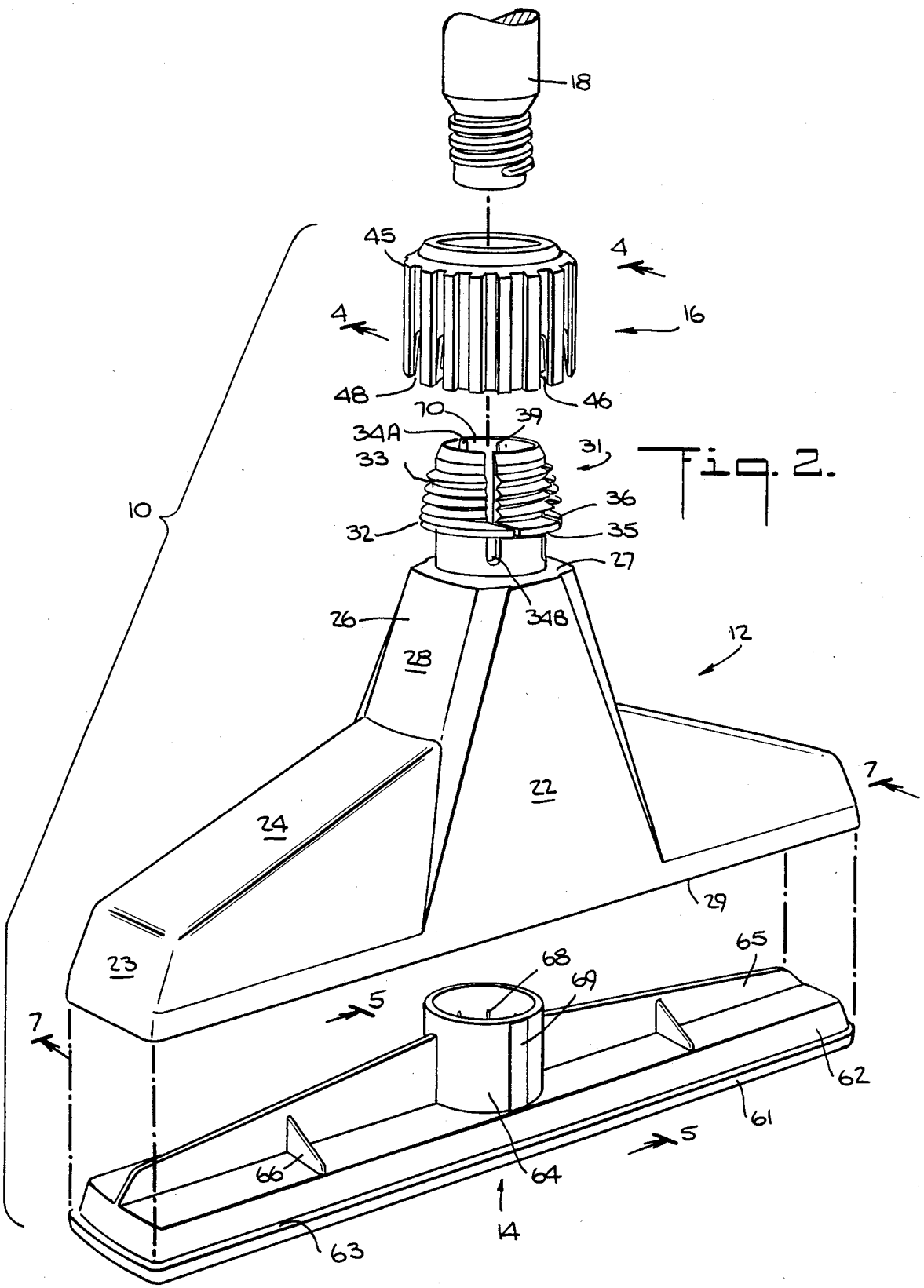
FIG. 2 is an exploded perspective view of the preferred embodiment of the broom shroud of the present invention.

Referring to FIG. 2, an exploded perspective view of the preferred embodiment of the broom shroud 10 of the present invention, the broom shroud 10 comprises a broom shroud housing 12, a bristle block 14, and a locking cap 16, these elements being shown in assembly in FIG. 1. In FIG. 1 a broom that incorporates the broom shroud 10 of the present invention is shown to include bristles 15 extending downwardly from the bristle block 14, and a broom handle 18 extending upwardly from the broom shroud housing 12.

The preferred embodiment of the housing 12 shown in the FIGS. 1 and 2 has an elongate configuration, with longitudinal side walls 22 and lateral side walls 23. Top wall segments 24 slope upwardly from the lateral side walls 23 toward the midpoint of the housing 12, intersecting at 25 a pyramidal extension 26 of the housing 12, the extension 26 having a truncated top 27, from which a neck member, shown generally as numeral 31, extends. The neck member 31 has a central bore 70, and comprises, as will be more fully described below, a collet or exterior neck portion 32, shown in FIG. 2, and a socket or interior neck portion 72, shown in FIG. 7. The pyramidal extension 26 is formed essentially by opposed, sloping walls 28, and by the longitudinal side walls 22 of the housing. The housing 12 is essentially hollow, and the bottom thereof is open.

Although a specific embodiment of the housing 12 is shown in the drawings, it should be understood that the overall configuration of the housing is to a great extent a matter of choice. For example, the side walls can be slightly sloped; the edges rounded or beveled; the height, length and width of the housing can be varied, depending upon the type of broom contemplated. Further, the pyramidal extension 26 is not an essential feature of the present invention. Hence, the top wall of the shroud can be horizontal, and the neck portion 31 would then extend from the midpoint thereof. Moreover, the neck member 31 comprising the collet 32 and socket 72 can be angled relative to the longitudinal axis, as would be required for incorporation of the present invention in a push broom.

The cylindrical collet or exterior neck portion 32 has an externally threaded section 33, and is provided with a plurality of vertical through slots 34. At least one of said plurality of slots 34 is wholly disposed in a quadrant of the collet, the quadrant being defined by intersecting vertical planes coplanar with the longitudinal and lateral axis of said housing 12, said at least one slot having a wall defined by a vertical plane essentially normal to the longitudinal axis of the housing. The slots 34, preferably three or four in number, extend from the top of the collet through the threaded section 33 and into the lower portion of the collet 32, terminating proximate the top 27 of the pyramidal extension 26. In the preferred embodiment of three or four slots, the slots form arcuate collet segments of from about 75° to about 150° of arc.

As shown in FIG. 2, and more clearly illustrated in FIG. 3, an enlarged view of the collet 32, the collet 32 includes a locking cap retaining ring 35 in the form of an annular flange, the ring being positioned below the threaded section 33 and discontinuous thereof, with the slots 34 extending below the ring, to proximate the top 27 of the housing 12. The ring 35 is split by slots 36, which slots 36 correspond to slots 34 in the collet. The ring, in combination with lock protrusions integral with the locking cap 16, loosely retains the cap 16 on the collet 32 without threaded engagement, as is described in greater detail below.

In the embodiment shown in FIGS. 2 and 3, three slots 34 are provided in the collet 32, one of which is designated as type A, and two of which are designated as type B. Slot type A is considered herein to be diametrally disposed to the collet 32 normal to the longitudinal center axis of housing 12, the walls 37 of said slot type A being substantially parallel. Slots type B are each between about 100° to about 150° of arc from slot 34 type A, and have walls 37 that are diametral to the collet 32 and walls 37' that are beveled or chamferred with respect to the collet 32. As shown herein, the slots 34 type B are mirror images of one another. The top of the collet 32 is provided with a beveled edge 38, and the threaded section 33 is slightly divergently tapered from top to bottom, such that the general configuration of slot type B is that of a pyramid. The taper provided to the threaded section is up to about 10°, preferably from 1° to about 5°.

The orientation and configuration of the slots in the collet described above is advantageous in two respects. First, if molded from plastic in two longitudinal sections, it has been found that the described slot geometry enables, with conventional molds and molding techniques, to withdraw each section easily from the mold. In this regard it is preferred to have one wall of the slots type B normal to the longitudinal axis of the housing. Hence, walls 37' are beveled with respect to the circular periphery of the collet 32, and provide parallel opposed surfaces facilitating removal of a housing section from the mold. With regard to their pyramidal shape, it has been found that chordal slots wherein both walls are both parallel and normal to the longitudinal housing axis, if used in lieu of the type B slots, have thread segments defined by the pyramidal cut-out that are less resistant to the compression forces acting on the collet when the cap is tightened.

The ring slots 36 are collinear with one edge of the slots 34. Preferably, slots 36 are collinear with the beveled walls 37' of the type B slots. The ring 35 has an external diameter which is at least that of the crest diameter of the lowermost or largest thread of the tapered threaded section 33, as hereinafter explained. Finally, the interior surface of the bore 70 is shown to have a plurality of lands 39, which bite into the handle 18 when the locking cap 16 is tightened about the collet.

Figure 4:
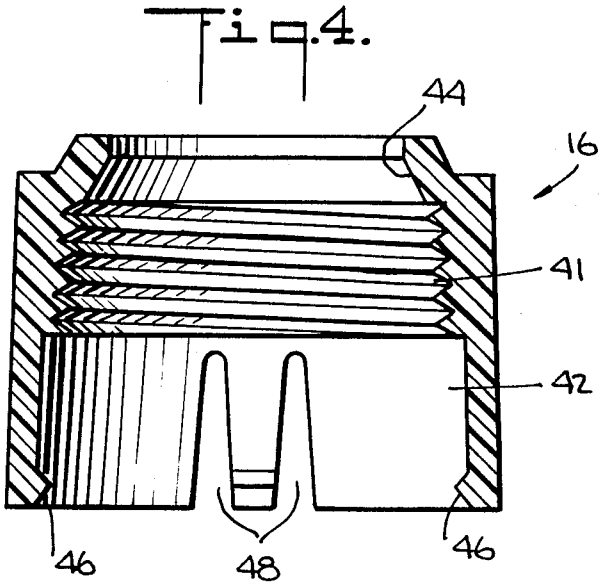
FIG. 4 is an enlarged cross-sectional view of the locking cap across section 4—4 of FIG. 2.

Referring to FIG. 4, a cross-sectional view of the preferred embodiment of the locking cap, the cap 16 comprises a hollow tubular member having an upper threaded section 41 and a lower section 42, the lower section having an internal diameter larger than that of the threads 33. The threaded section 41 has a taper corresponding to the taper of the collet threaded section, and also has a beveled interior lip 44 corresponding to the beveled top 38 of the collet. The outer surface of the cap 16 is provided with a plurality of ribs 45 (see FIG. 2) that provide a superior gripping surface. As shown in FIG. 4 the cap 16 is provided with a plurality of opposed paired V-shaped lock protrusions 46 extending inwardly into the cap. The lock protrusions 46 have a root diameter which is smaller than the ring 35 diameter, such that the cap can be snapped onto the collet without threaded engagement. This feature prevents loss of the cap during shipment or when the handle is being replaced. Slots 48 on either side of the lock protrusions, which extend partially upwardly from the bottom of the cap, provide greater outward flexing of the lock protrusions 46. Preferably, the opposed locking cap lock protrusions do not align with the retaining ring slots 36, and are wider than said slots 36, thereby ensuring retension of the cap on the collet in all orientations. This is achieved by proper selection of the slot 36 and protrusion 46 locations and dimensions.

Referring back to FIG. 2 the bristle block 14 comprises an elongate member having a lower base portion 61 and an upper base portion 62, there being a lip 63 formed therebetween, the lip being matable with the peripheral bottom edge 29 of the housing 12. Extending from the upper base portion 62 is a cylindrical sleeve 64, from which longitudinal ribs 65 extend to the two latitudinal ends of the base portion 62. A plurality of stiffener ribs 66 may be provided transversely to the ribs 65, as illustrated.

Figure 5:
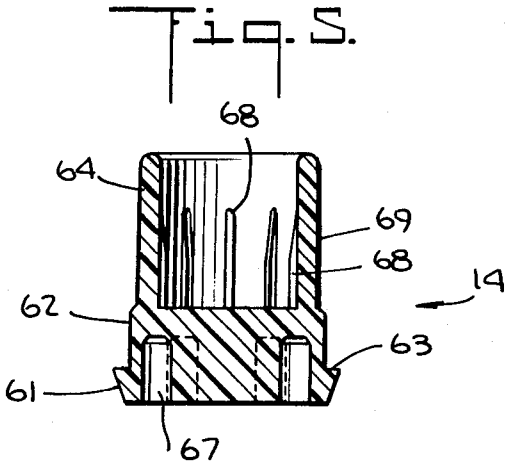
FIG. 5 is a cross-sectional view of the bristle block across section 5—5 of FIG. 2.
Figure 6:
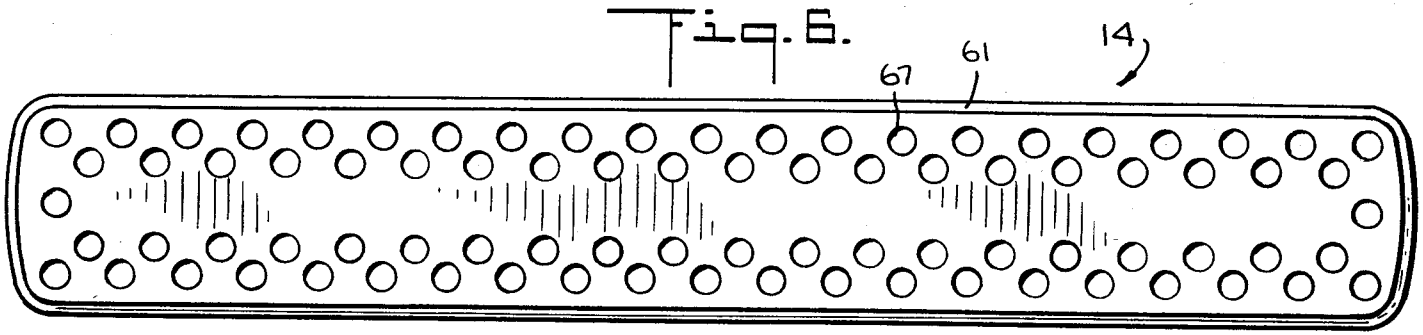
FIG. 6 is a bottom view of the bristle block.
Figure 8:
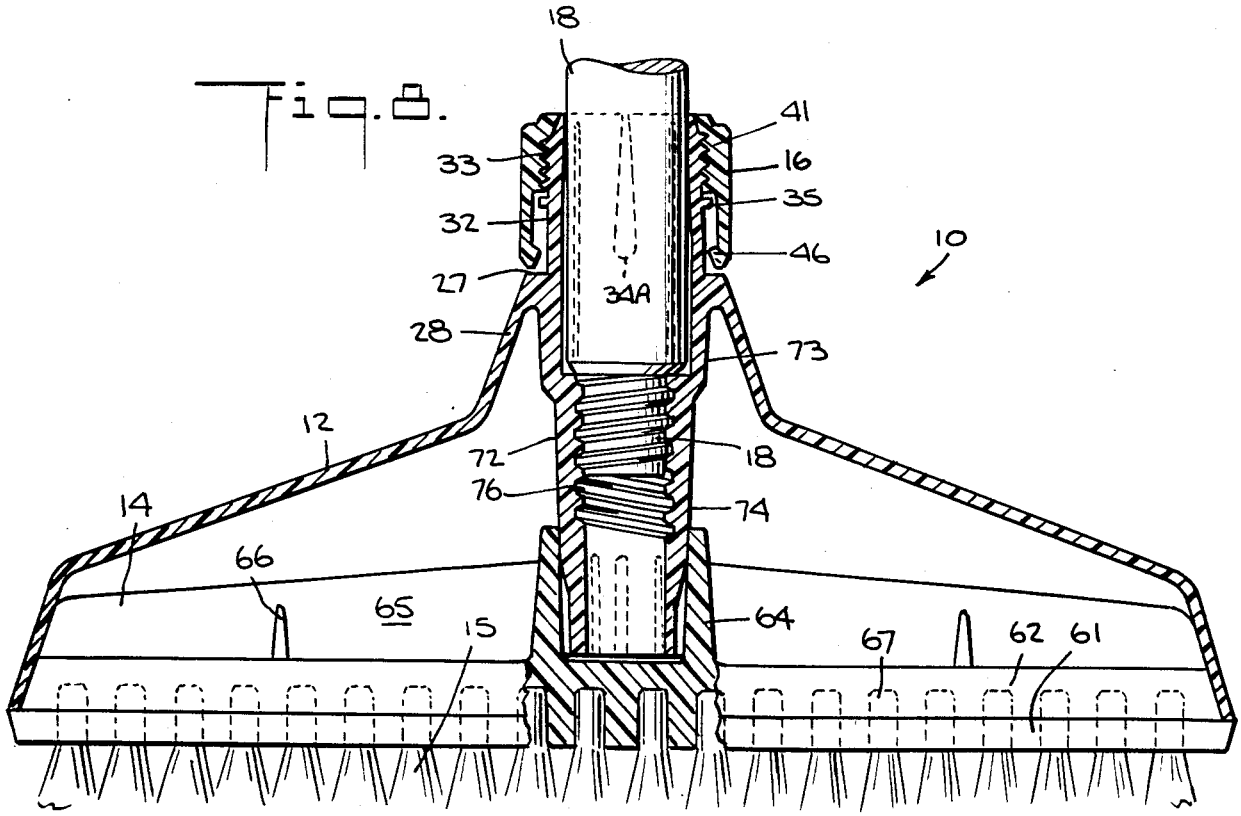
FIG. 8 is an assembled longitudinal cross-sectional elevational view of a broom incorporating the broom shroud of the present invention, across section 8—8 of FIG. 1.

As seen in FIGS. 5 and 6, a plurality of holes 67 are provided in the bottom of the block 14, tufts of the bristles 15 being anchored in the holes 67. In the interior of the sleeve 64 is a plurality of vertical lands 68, which provide a gripping surface for the socket 72, which is insertably located within the sleeve 64 and affixed therein by suitable adhesive (FIG. 8). The sleeve 64 may also be provided with opposed flat surfaces 69, and the block 14 affixed to the housing 12 by staples (not shown) passing through side walls 22 and into surface 69.

Figure 7:
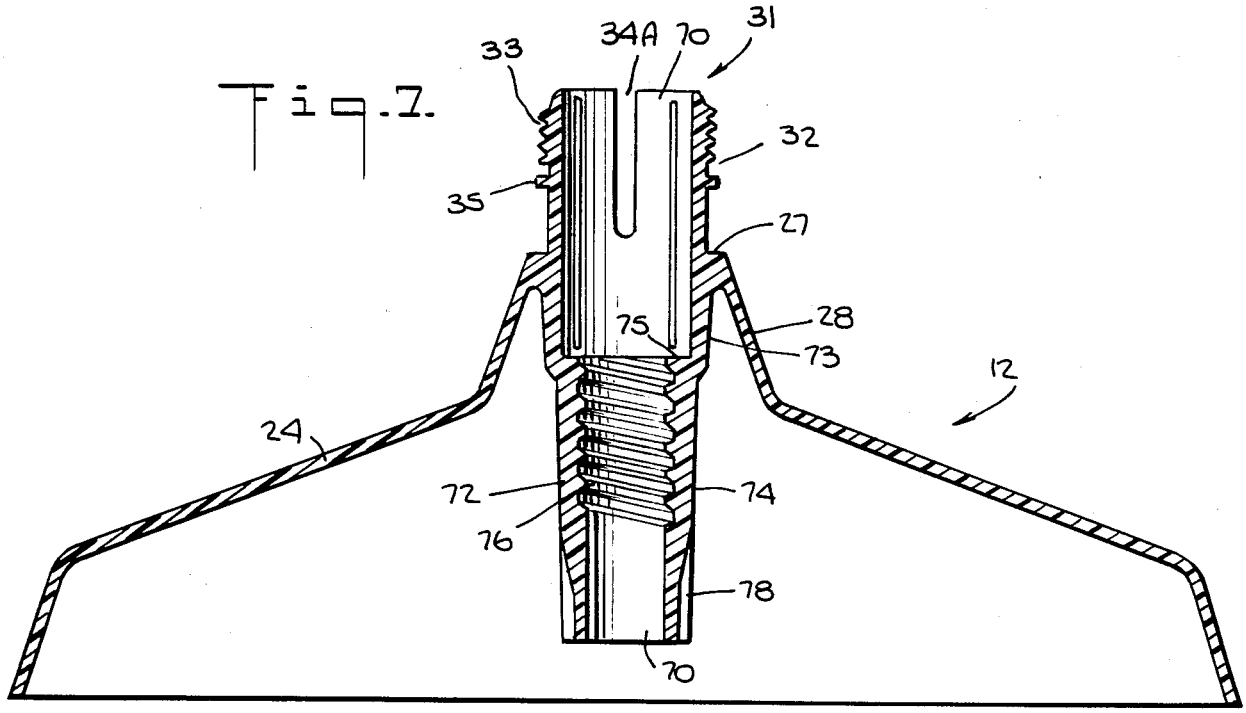
FIG. 7 is a longitudinal cross-sectional elevational view of the broom shroud across section 7—7 of FIG. 2.

Referring to FIG. 7, a cross-sectional view of the shroud housing, the socket 72 is seen to be an extension of the collet or exterior neck member 32 into the hollow housing 12. In the embodiment shown, the socket 72 has an upper portion 73 and a lower portion 74 of reduced diameter, the bore 70 similarly being reduced in diameter at the intersection of portions 73 and 74, a shoulder 75 being formed thereat. The bore 70 has a threaded interior section 76 in the lower portion 74, which receives the threaded end of a broom handle, with the shoulder formed between the shank and body of the handle adjacent the shoulder 75. The exterior surface of the lower portion 74 of the socket 72 has a plurality of vertical grooves 78, which receive the lands 68 in the sleeve 64 of the bristle block 14.

FIG. 8 is an assembled longitudinal cross-sectional elevational view of the broom shroud 10 with handle 18 and bristles 15 shown. The bristle block 14 is affixed to the shroud 12 by adhesively or otherwise anchoring the lower portion 74 of socket 72 within the sleeve 64. The threaded broom handle 18 is inserted into the bore 70, and threadedly connected to the shroud housing at the lower portion 74 of the socket 72. The depth of the lower section 74 and of the threads 76 is selected for conventional threaded or unthreaded broom handles, but may be varied for any particular handle. The shoulder of the handle abuts the shoulder 75 formed at the interface of portions 73 and 74 of bore 70. However, an unthreaded broom handle can be used, i.e., a broom handle not having a threaded shank. With an unthreaded broom handle the bottom end of the handle abuts the shoulder 75 in the socket 72.

The locking cap 16 is then screwed onto the neck 31. As the cap is tightened, the collet 32, in view of the slots 34, is pinched against the body of the handle 18, thereby providing a connection that does not loosen during ordinary use of the broom, yet that is removable in the event that the handle requires replacement. Illustratively, slot 34A is shown compressed in FIG. 8. When unscrewed, the cap is retained loosely on the neck 31 by means of the lock protrusions 46 which engages the underside of annular flange 35 on the collet 32, hence preventing loss of the cap.

The housing 12, the bristle block 14 and the locking cap 16 are each preferably manufactured from plastic by molding.

Although the preferred embodiment of the present invention has been described and illustrated, it will be obvious to those skilled in the art that various changes and modifications can be made without departing from the spirit and scope of the invention defined by the claims appended below.

We claim:

1. A broom shroud adapted to receive a a broom handle, the broom shroud comprising:

(a) a broom shroud housing having a neck member having a bore to receive the broom handle, said neck member comprising:

(i) a collet or exterior neck portion extending upwardly from the top of the housing, the collet being provided with an externally threaded section and a plurality of vertical through slots extending from the top of the collet through the threaded section, at least one slot being wholly disposed in a quadrant of the collet, the quadrant being defined by intersecting vertical planes coplanar with the longitudinal and lateral axes of said housing, said slot having a wall defined by a vertical plane normal to the longitudinal axis of the housing, and (ii) a socket or interior neck portion extending inwardly into the housing from the collet;

(b) an internally threaded locking cap adapted to engage said collet, and (c) means for securing bristles to said housing, whereby fastening the locking cap to the housing compresses the slotted portion of the collet, said collet tightly engaging the broom handle received by the bore.

2. The broom shroud of claim 1 wherein the number of through slots in the collet is from 3 to 4, said slots extending below the threaded section and forming arcuate collet segments of from about 75° to about 150°.

3. The broom shroud of claim 2 wherein the socket portion of the bore in the neck member is provided with a threaded section, whereby a threaded broom handle is directly securable to said housing.

4. The broom shroud of claim 3 wherein the socket portion of bore of the neckmember has a lower portion of reduced diameter forming therein a shoulder, said threaded section being in the lower portion of reduced diameter.

5. The broom shroud of claim 2 wherein the housing has an open bottom end and wherein the means for securing the bristles thereto comprises a bristle block having a centrally disposed circular sleeve, said bristle block being affixed within the open bottom end of the housing with the sleeve engaging the socket of the neck member, said bristle block having a plurality of tufts of bristles attached thereto.

6. The broom shroud of claim 2 wherein the collet is provided with a locking cap retaining ring in the form of an annular flange, said retaining ring positioned below the threaded section and having a diameter at least that of the crest diameter of each thread, the retaining ring having a plurality of slots, and wherein the locking cap comprises a hollow tubular member having a threaded interior upper section adapted to engage the collet threaded section and an unthreaded interior lower section of larger diameter than the retaining ring, and a plurality of opposed inwardly projecting lock protrusions at the periphery of the bottom of the cap, the diametral distance between the opposed lock protrusions being less than the ring diameter, whereby said cap can engage the collet without engagement of the threads.

7. The broom shroud of claim 6 wherein the retaining ring slots correspond to the slots in the collet, the collet slots extending below said retaining ring, and wherein the orientation of opposed lock protrusions avoids alignment of same with the slots in the retaining ring.

8. The broom shroud of claim 6 wherein the lower section of the locking cap is provided with slots adjacent the lock protrusions.

9. The broom shroud of claim 2 wherein the threaded section of the collet is proximate the top thereof, the threaded section having a taper from top to bottom of from about 1° to about 10°, and the threaded section of the locking cap is correspondingly tapered.

10. The broom shroud of claim 2 wherein the number of slots in the collet is three, the first slot being diametral to the collet, the second and third slots being generally pyramidal in configuration with one wall diametral to the collet and the other wall essentially parallel to the first slot.

11. The broom shroud of claim 10 wherein the second and third slots are mirror images of one another.

12. The broom shroud of claim 1 wherein the housing is elongate and has sloped top walls intersecting a pyramidal extension truncated at the top, the collet extending therefrom.

13. A broom incorporating the broom shroud of claim 1.

14. A broom incorporating the broom shroud of claim 6.

15. A broom incorporating the broom shroud of claim 11.

16. A broom shroud adapted to receive a broom handle, the broom shroud comprising:

(a) a broom shroud housing having a neck member having a bore to receive the broom handle, said neck member comprising:

(i) a collet or exterior neck portion extending upwardly from the top of the housing, the collet being provided with an externally threaded section proximate the top thereof, said collet having three vertical through slots extending from the top of the collet to below the threaded section, one slot being diametral to the collet, and the two remaining slots having one wall diametral to the collet and the other wall beveled as to be essentially parallel to the first slot such that said remaining slots are generally pyramidal in configuration, and (ii) a socket or interior neck portion extending inwardly into the housing from the collet, the bore of the socket having a lower portion of reduced diameter that is provided with a threaded section;

(b) a locking cap which is a tubular hollow member having a threaded interior upper section and an unthreaded lower section of larger diameter, and (c) a bristle block having a lower base and an upper base, with a lip formed therebetween, said block having a centrally disposed hollow circular sleeve extending upwardly from the upper base and a plurality of holes in the lower base for receiving tufts of bristles, the block being affixed within the bottom of housing, the bottom edge thereof mating with the lip, and the sleeve receiving the socket of the neck member, whereby fastening the locking cap to the housing compresses the slotted portion of the collet, said collet tightly engaging the broom handle received by the bore, which broom handle is threadedly connected to the housing in the socket.

17. The broom shroud of claim 16 wherein the threaded section of the collet is tapered from top to bottom, and the threaded section of the locking cap is correspondingly tapered.

18. The broom shroud of claim 17 wherein the collet is provided with a locking cap retaining ring, said retaining ring positioned below the threaded section thereof and having a diameter at least that of the crest diameter of the bottom thread, the retaining ring having slots corresponding to the slots in the collet, said ring slots corresponding to the pyramidal collet slots being collinear with the beveled walls thereof, and wherein the locking cap has a plurality of opposed inwarding projecting lock protrusions at the periphery of the bottom edge of the cap, the diametral distance between the opposed protrusions being less than the ring diameter, there being provided slots in the peripheral locking cap wall adjacent said lock protrusions, whereby said cap can engage the collet without engagement of the threads.

19. The broom shroud of claim 18 wherein said slots in the collet form collet segments of from 100° to 150° of arc, and wherein the taper of the threaded collet and cap sections is from 1° to 5° off vertical.

20. A broom incorporating the broom shroud of claim 19.

21. The broom shroud of claim 2 wherein a plurality of slots are quadrantally disposed.

22. The broom shroud of claim 21 wherein each wall of the slots disposed within a quadrant lies in a vertical plane normal to the longitudinal axis of the housing.

23. A broom incorporating the broom shroud of claim 2.

24. In a broom shroud adapted to receive a broom handle, said broom shroud having a broom shroud housing having a neck member with a bore to receive the broom handle, said neck member having a collet portion provided with a plurality of slots, and a locking cap adapted to engage and compress said collet, the improvement comprising providing at least one slot wholly disposed in a quadrant of the collet, the quadrant being defined by intersecting vertical planes coplanar with the longitudinal and lateral axes of said housing, said slot having a wall defined by a vertical plane normal to the longitudinal axis of the housing.

25. The broom shroud of claim 24 wherein the broom shroud housing is of unitary construction.

26. The broom shroud of claim 25 wherein the number of slots in the collet is from 3 to 4.

27. The broom shroud of claim 26 wherein a plurality of slots are quadrantally disposed.

28. The broom shroud of claim 27 wherein each wall of the slots disposed within a quadrant lies in a vertical plane normal to the longitudinal axis of the housing.

29. The broom shroud of claim 27 wherein the walls of the slots opposite the wall normal to the housing longitudinal axis are diametral the collet.

30. The broom shroud of claim 28 wherein said neck member further comprises a socket or interior neck portion extending inwardly from the collet into the housing.

31. The broom shroud of claim 29 wherein said neck member further comprises a socket or interior neck portion extending inwardly from the collet into the housing.

32. The broom shroud of claim 28 further comprising means for securing bristles to said housing.

33. The broom shroud of claim 29 further comprising means for securing bristles to said housing.

* * * * *